US006120203A

United States Patent [19]

Modders

[11] Patent Number: 6,120,203

[45] Date of Patent: Sep. 19, 2000

[54] MASTIC APPLYING DEVICE

[76] Inventor: John W. Modders, P.O. Box 1422, Punta Gorda, Fla. 33951-1422

[21] Appl. No.: 09/096,152

[22] Filed: Jun. 11, 1998

[51] Int. Cl.[7] ..... B05C 17/00

[52] U.S. Cl. ..... 401/181; 401/266; 401/139

[58] Field of Search ..... 401/181, 266, 401/139; 222/391, 392

[56] References Cited

U.S. PATENT DOCUMENTS

| | | | |
|---|---|---|---|
| 1,025,511 | 5/1912 | Craven | 222/392 |
| 1,038,180 | 9/1912 | Moreland | 401/266 X |
| 2,438,843 | 3/1948 | Correa | 222/391 |
| 2,804,767 | 9/1957 | Schoen | 101/266 X |
| 3,016,040 | 1/1962 | Crookston, Jr. | 401/266 X |
| 4,793,526 | 12/1988 | Webb | 222/391 |

FOREIGN PATENT DOCUMENTS

| | | | |
|---|---|---|---|
| 652468 | 11/1937 | Germany | 401/181 |
| 424156 | 8/1947 | Italy | 401/181 |

*Primary Examiner*—Steven A. Bratlie
*Attorney, Agent, or Firm*—Frank A. Lukasik

[57] ABSTRACT

A device for applying textured ceiling plaster or mastic on sheet rock or other surfaces both from a standing position and beyond a normal person's reach is provided. A wire is passed through an outer sheathing into an elongated tube and attached to the head of a piston remote from the tube outlet, and plaster, mastic or "mud" is introduced into the tube to force the piston away from the outlet. A return wire is attached to the piston base support to facilitate return of the piston to a starting position. The length of the tube may be varied to permit more remote application of the material in the chamber.

2 Claims, 5 Drawing Sheets

MASTIC APPLYING DEVICE

BACKGROUND OF THE INVENTION

1. Field of the Invention

The present invention relates to a device which allows textured ceiling plaster or other free-flowing material or slurries such as "mud" to be applied on the sheetrock or other surfaces beyond the normal reach of the person applying it. A piston inside of a tube is connected to a puller wire that extends out one end of the tube, down a selected length of the tube, and terminates in a ratchet assembly at an intermediate section of the tube. The outer length of the wire is protected in a sheathing, and the wire is wound over a pulley by the ratchet assembly, drawing the piston toward the one end of the tube thereby expelling any material that may have been introduced into the tube. The material or plaster or slurry is introduced at the one end of the tube through a filler valve assembly, forcing the piston toward the remote end of the tube. The pulley is turned by depressing a ratchet handle that operates the ratcheting assembly. A pawl locks against each cog to prevent it from being oppositely rotated.

2. Description of the Prior Art

The prior art discloses various devices for use by one person to apply drywall texture and other materials. For example, U.S. Pat. No. 3,070,827 to Ames discloses a mastic applying tool in which a cylinder is moved with respect to a stationary piston using a cable. After the cylinder has been filled with mastic through a loading valve at the head of the cylinder the operator turns a drum, winding the cable thereon and drawing the cylinder toward an end cover at the head to which the cable is attached. In applicant's device, however, the cable is attached to and draws the piston toward the head of the cylinder which means that instead of moving a bulky cylinder he moves a relatively light piston. In effect, in Ames the piston is pushed through the cylinder whereas in applicant's device the piston is pulled through the mastic. The Ames device thus is submitted as not anticipating applicant's invention for these among other reasons.

U.S. Pat. No. 4,979,649 to Westcott concerns an extender apparatus for a caulking gun having an axially displaceable piston, a front face having an opening, and a trigger mechanism for incrementally advancing the piston along a predetermined axis, the extender including an elongated skeletal frame for supporting a cartridge of caulking compound. The device includes an adapter for connecting the frame to the front face of the caulking gun, an adjustable pivot for adjusting the relationship of the frame to the front face of the gun, and an auxiliary piston whereby a flexible shaft may be advanced incrementally by the incremental movement of the gun piston. The use of a cartridge and the absence of a piston in a cylinder alone patentably distinguish applicant's device over that of Wescott.

U.S. Pat. No. 4,948,054 to Mills discloses a portable sprayer powered by an air supply for applying a liquid texture material, and otherwise lacks many of the features of applicant's invention and therefore cannot anticipate applicant's invention. U.S. Pat. No. 4,784,598 to Kranz et al concerns a hand held resilient flexible application member and is not related to the piston delivery system of the present invention. U.S. Pat. No. 4,907,955 to Snipes is a drywall finishing tool that may be used to apply a layer of plastic but lacks the feature to feed plaster, mud, etc. as in the present invention. U.S. Pat. No. 5,069,610 to Milburn concerns another form of mastic or plastic material applicator and lacks any features that could be considered anticipatory of applicant's invention. U.S. Pat. No. 4,440,410 to Bradshaw relates to a hopper for containing drywall joint compound or "mud" used in covering seams between drywall panels and fails to anticipate any significant details of applicant's invention.

It can be readily appreciated that these references, either singly or in combination, do not teach suggest nor infer the method and means of the present invention for providing a piston assembly wherein a piston is pulled through a dispensing tube to apply plaster, "mud" or other slurries to sheetrock or other surfaces beyond the normal reach of persons applying it.

SUMMARY OF THE INVENTION

Accordingly, it is an object of the invention to provide a system for applying mastic, plaster, or other slurries to sheetrock or other surfaces beyond the normal reach of persons applying it.

It is another object of the invention to provide such a system in which the material to be applied is forced out of a cylinder by a piston connected to a pulling wire.

It is a still further object of the invention to provide such a system in which the cylinder may be readily extended to permit more remote surfaces to be reached.

It is yet another object of the invention to provide such a system wherein material is admitted to the cylinder by forcing a dispensing piston into the cylinder.

It is yet another object of the invention to provide such a system wherein the pulling wire extends out of the cylinder head and alongside the cylinder through a guide tube to a ratchet assembly and the contents of the cylinder are dispensed to a blade at the cylinder end where material is admitted.

The foregoing objects are realized by the present invention in a device which allows textured ceiling plaster or other free-flowing material or slurries such as mud to be applied to sheetrock or other out of reach surfaces while the person applying it is standing at floor level. The device includes a tube or cylindrical housing, substantially two inches in diameter and 56 inches in length in a preferred embodiment, which has a rubber grip to keep it from slipping in the hand. A piston is positioned inside the tube and a pulling wire or cable is attached to the piston, the wire extending out the end of the tube and down along the side thereof and being enclosed in a sheating that is clamped in position on the tube.

The wire is wound over a drum which is turned by squeezing on a handle that indexes a ratcheting arrangement. A pawl that locks against successive cogs in a cogwheel is provided to prevent the pawl from turning in the opposite direction. A feed spout is provided at the end where material is admitted into the tube for delivering plaster or "mud" to a blade that is curved outwardly for easy application on the ceiling or other surface. It will be appreciated that several types of texturing blades may be provided for operation in the unit.

A material such as mud is loaded by forcing it down into the tube through a mud-filler valve assembly at the spout end thereof, with the pawl disengaged, thereby driving the piston down into the tube until a desired of amount of material has been loaded. To dispense the mud, the handle is squeezed and released repeatedly, thereby ratcheting the drum around to pull up the piston and forcing the mud into the spout and onto the blade. Each squeeze of the handle places more mud on the blade thereby placing substantially less strain on the operator once he is working at floor level in lieu of standing on stilts or a ladder to apply the mud or plaster. Also, the work is done much more rapidly because a hawk and trowel are no longer used, the quality of work is better, the floor is drier, and there is less danger of falling, among other advantages of the invention.

DETAILED DESCRIPTION OF THE INVENTION

Figure 1:
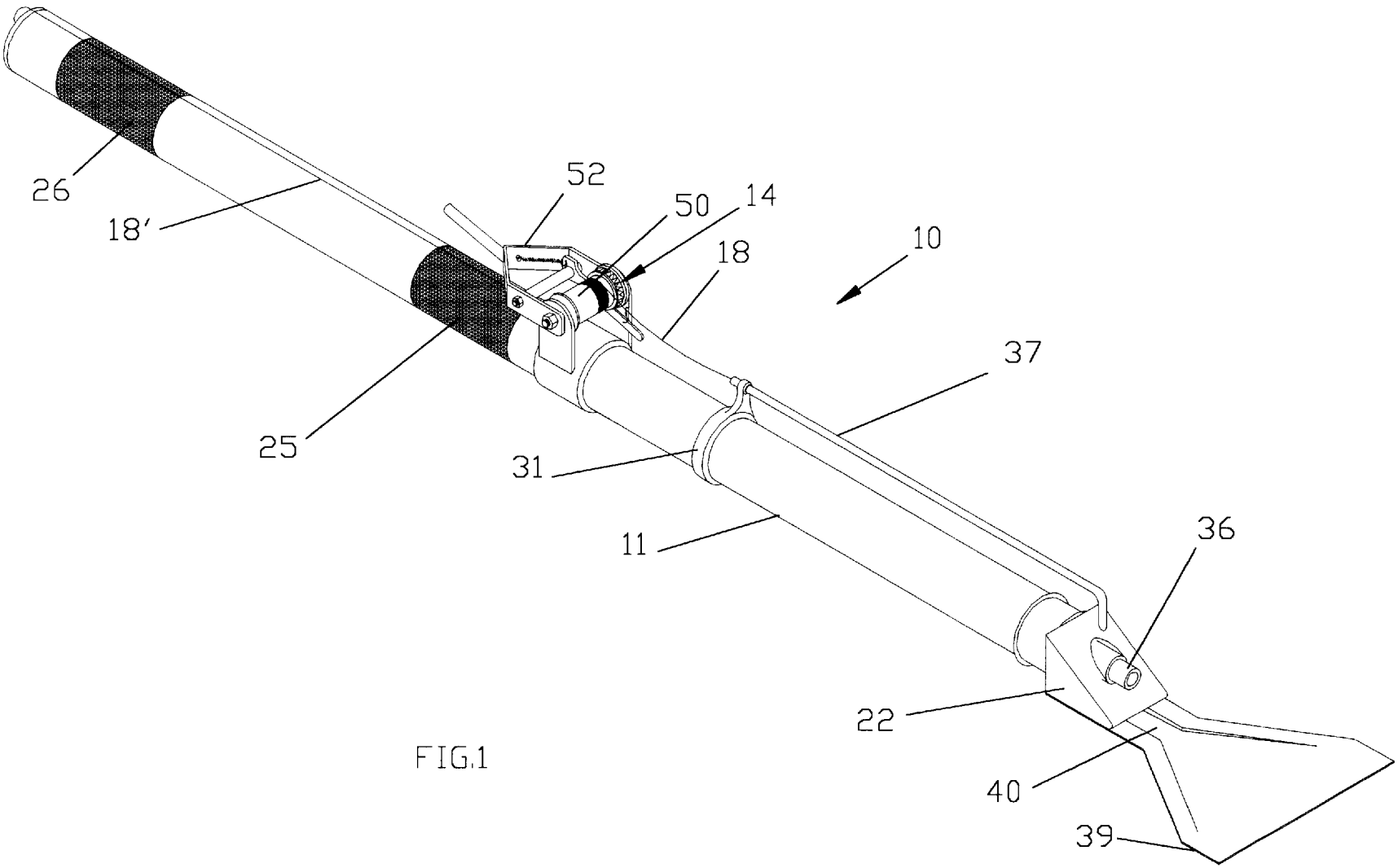
FIG. 1 is a perspective view of a preferred embodiment of the invention.
Figure 2:
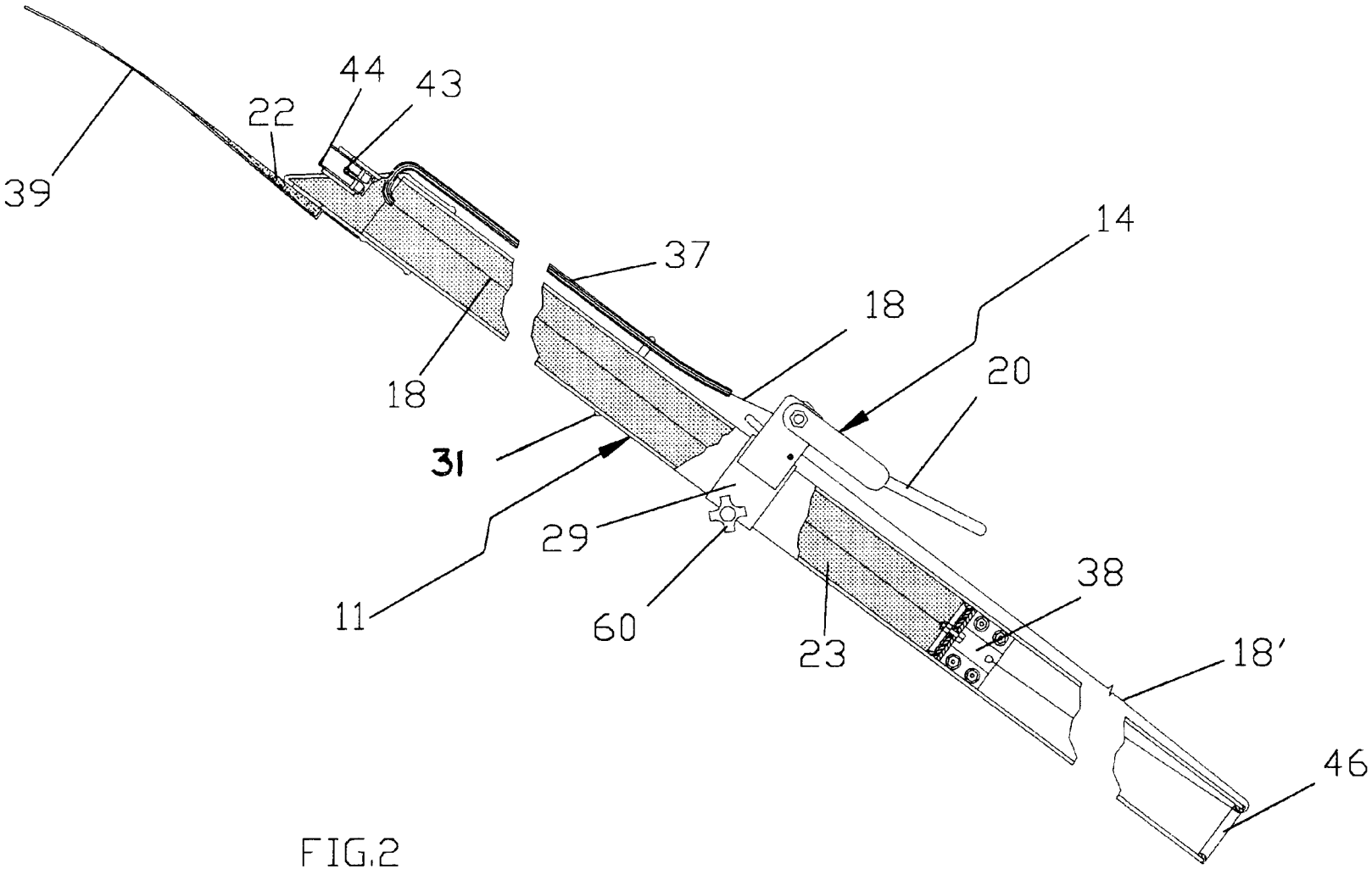
FIG. 2 is a side elevation, partly in section, of the embodiment of FIG. 1.
Figure 3:
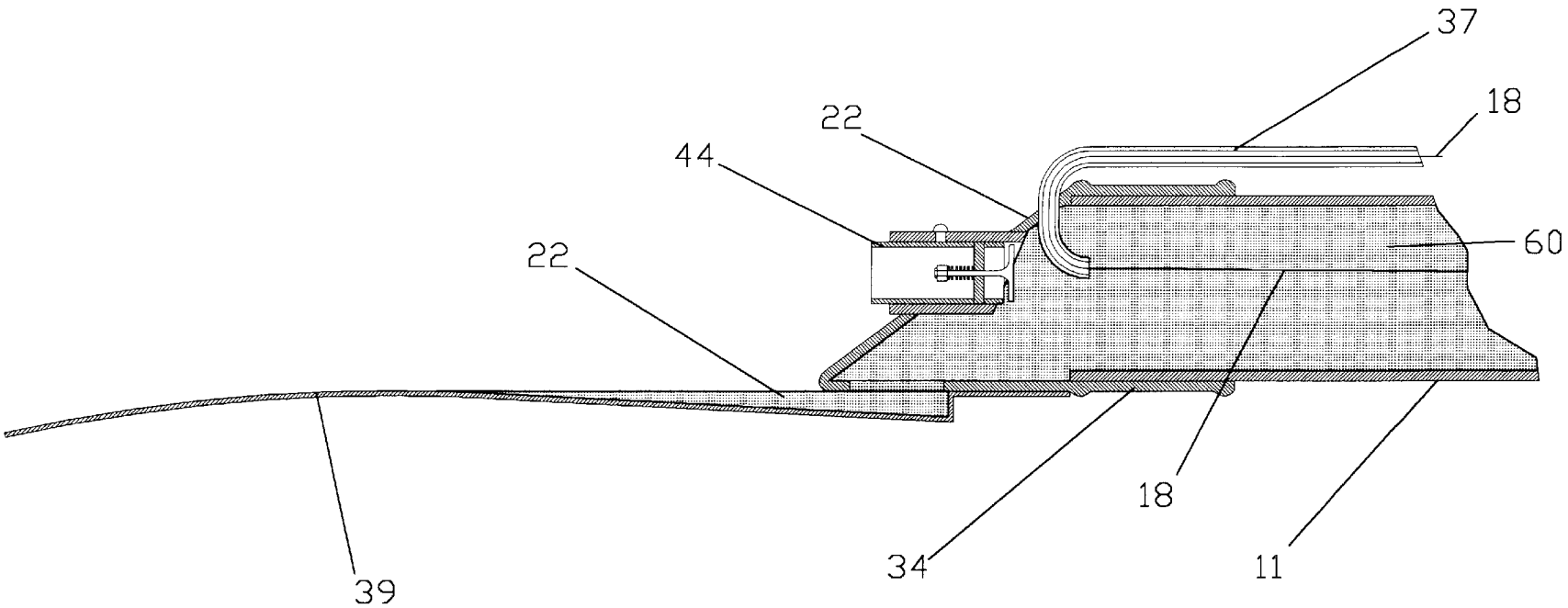
FIG. 3 is a sectional view of the filling and dispensing assembly in the embodiment shown in FIG. 1.
Figure 4:
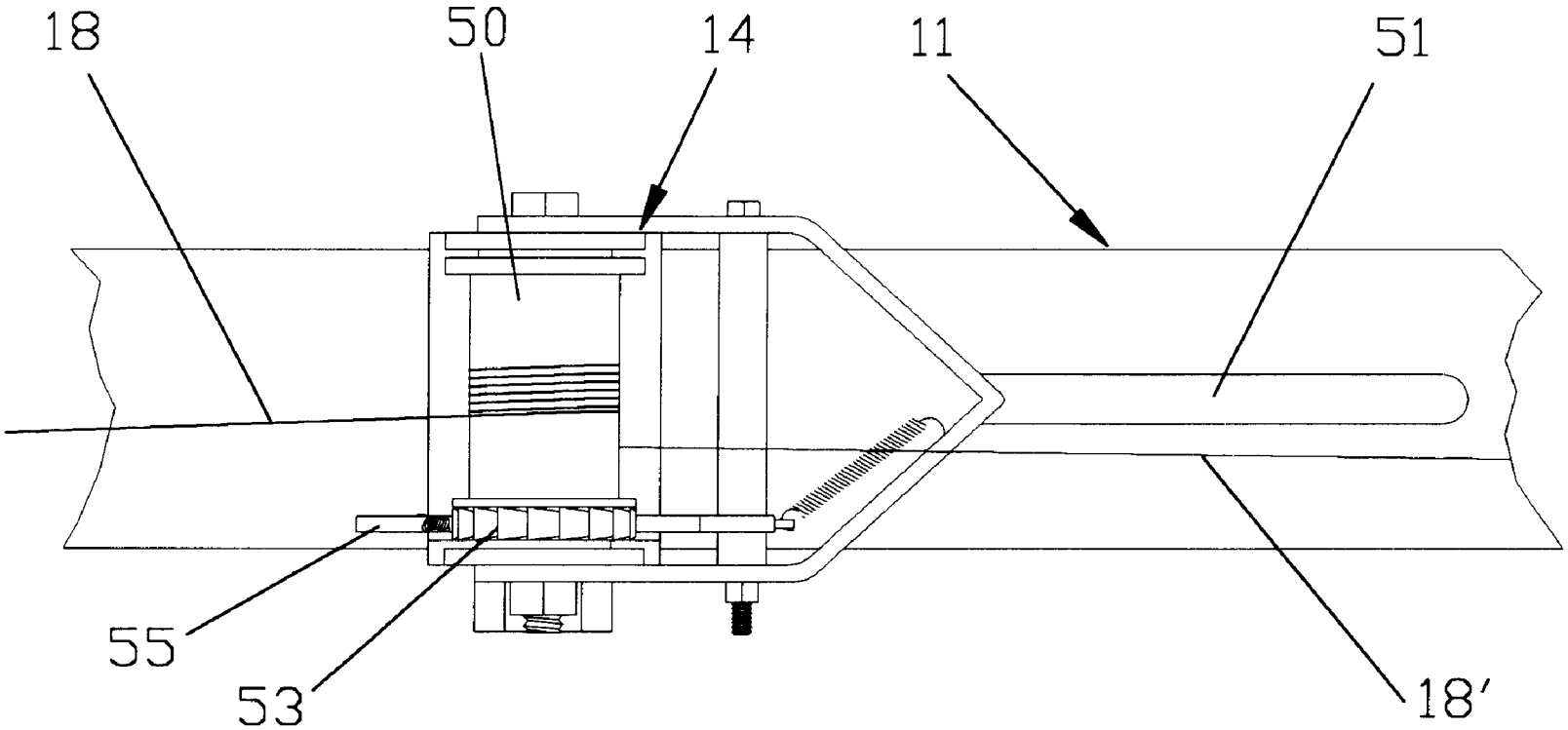
FIG. 4 is a plan view of the ratchet assembly of the embodiment shown in FIG. 1.
Figure 5:
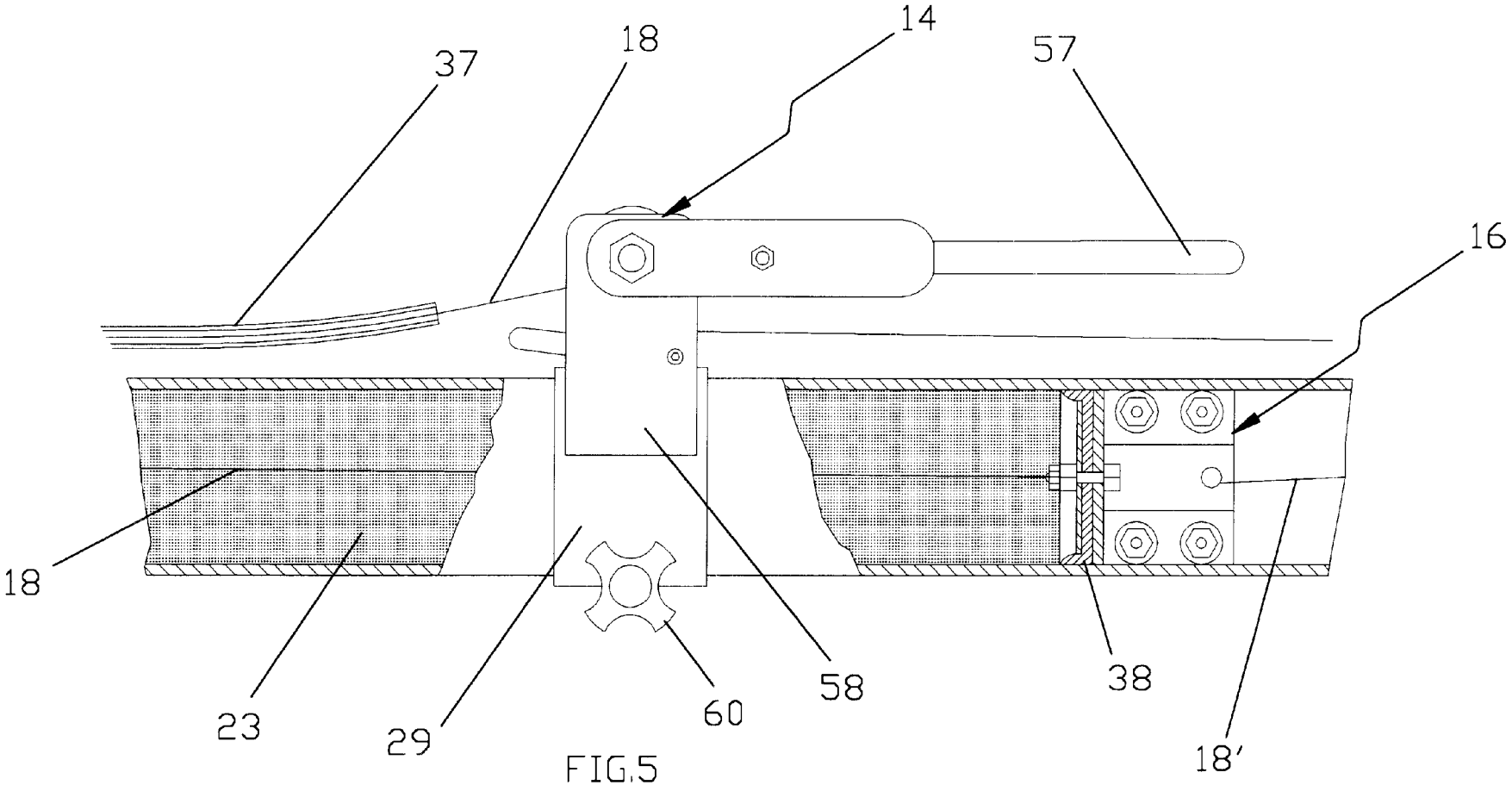
FIG. 5 is a side elevation partly in section, of the ratchet assembly of the embodiment shown in FIG. 1.

Turning to the drawings, more particularly to FIG. 1, there is shown a preferred embodiment of the invention in perspective 10 which includes basically three components, a main cylindrical tube 11, a ratchet assembly 14, shown in greater detail in FIGS. 4 and 5, which includes a piston and plunger assembly 38 shown in FIGS. 2 and 5 and a puller wire 18 and return puller wire 18', and a filling and dispensing assembly 22 shown in greater detail in FIG. 3. Tube 11 is provided with hand grips 25 and 26 for secure handling, a ratchet mounting bracket 29, a wire and wire sheathing mounting bracket 31, and a blade mount and fitting assembly 34, shown in FIG. 3.

Tube 11 is filled through a filler valve assembly 36, shown in greater detail in FIG. 3, puller wire 18 is passed through a sheating or guide tube 37 into the main tube 11 and attached to piston 38 in plunger assembly 16, and the return end 18' of puller wire 18 is attached to the end of the plunger assembly opposite to where puller wire 18 is attached to maintain a positive connecting means for returning plunger assembly 16 to a starting position. Filling and dispensing assembly 22 includes a blade 39 having an outlet 40.

Referring now to FIGS. 1–5, assembly 22 includes a spring-loaded valve 43 in a cylinder 44 for control during filling. Tube 11 preferably is open as indicated at 46 to allow access to plunger assembly 16 and to provide for free movement of return puller wire 19. Ratchet 14 includes a drum 50 on which wire 18 is wound, a ratchet handle 51 connected to a cogwheel 53, and a pawl 55 for preventing backward rotation of cogwheel 53. A mounting bracket 58 for drum 50 and a knob 60for securing bracket 29 to tube 11 in conjunction with a conventional clamp assembly, not shown, complete the operative components of assembly 14.

In operation, particularly referring to FIGS. 2 and 4, a plaster, mastic or other form of slurry 62 is forced into tube 11 by conventional means, not shown, through cylinder 44 and valve 43 with ratchet assembly 14 disconnected, thereby forcing piston 38 and plunger assembly 16 into tube 11 until a desired amount of material has been introduced. In the process of filling tube 11, wires 18 and 18' are moved by plunger assembly 16 to, for example, the position shown in FIG. 2 after which the ratchet assembly is activated. Tube 11 is then moved around by its operator so that blade 30 is at the desired position after which repeated depressing of handle 51 will extrude the desired quantity of material onto the surface to be covered. The apron form of blade 39 serves to spread the material to a larger than normal area while the resilience of the blade 39 allows a uniform coating to be delivered over this area.

Tube 11 is adapted to be readily elongated thereby making it possible to cover areas much higher or farther and with lighter equipment than would normally be reached by existing textured ceiling plastering devices. In this respect, the present invention could also be made of reduced diameter to achieve a greater reach without adding greater weight to the device.

FIGS. 3 and 4 are enlarged views of the filling and dispensing features of the invention, FIG. 3 illustrating in particular the accurate shape of sheathing 37 inside tube 11 to assure that pulling line 18 is deployed centrally within the tube, while FIG. 4 illustrates in detail the dual function of ratchet assembly 14 and drum 50 in alternately moving plunger 16 in filling or dispensing modes of operation.

Although this invention has been disclosed and described with reference to a preferred embodiment, its principles are susceptible to other applications which will be apparent to persons skilled in the art. For example, a pulley could be installed at end 46 of tube 11 for return pulling line 18' to be passed over and another pulley could be installed inside of end 46 to guide the return line centrally within tube 11 to plunger assembly 16. The small diameter of the tube 11 in relation to its diameter provides for a device that can be easily handled and varied in length. Thus, many modifications, additions, and deletions may be made to the invention without departure from the scope of the invention as set forth in the following claims.

What is claimed is:

1. A device for applying drywall texturing material such as plaster to a drywall or similar surface consisting of:

a cylindrical housing for containing a quantity of texturing material and a texturing material in said housing, said cylindrical housing having a first end and a second end and having a flat, triangular shaped blade for spreading said material over a wide area and having a narrow opening at said first end for receiving material, a piston and plunger assembly slidably movable in said housing, said assembly being movable in a first direction for filling said housing with a selected quantity of said material and in a second direction opposite to said first direction for dispensing said material, said piston and plunger assembly having a face and an underside opposite said face, a ratchet assembly mounted on said housing, said ratchet assembly including a drum rotatable both clockwise and counterclockwise;

a puller wire having a first end and a second end, said first end being connected to said piston and plunger assembly face and at its second end to said underside of said piston and plunger assembly, said puller wire wound around said drum a plurality of times sufficient to preclude slipping thereon when rotated to dispense said material as said piston and plunger assembly is moved toward said first end of said housing, said puller wire being enclosed by a sheathing from a point adjacent to said ratchet assembly to a point near said housing first end for positioning said puller wire within said housing, and an arcuate shape of sheathing for preventing chafing of said wire where it enters said first end of said housing;

said ratchet assembly further including cog means for incrementally advancing said piston and plunger assembly toward said one end of said housing and pawl means for preventing reverse rotation of said drum during a material dispensing operation.

2. A device for spreading drywall texturing material such as plaster to a drywall or similar surface consisting of:

an elongated tube adapted to receive a quantity of texturing material, said tube having a first end and a second end and having means attached to said first end of said tube for spreading dispensed material onto a surface to dispense said material at said first end, said means for spreading dispensed material being a flat, triangular shaped blade having a narrow opening at one apex for directing passage of dispensed material to the wide area of said blade, a piston and plunger assembly slidably movable in said tube, said assembly having a first end and a second end, and having a puller wire connected at said second end and adapted to move in one direction to draw said material into said tube and having a puller wire connected at said first end adapted to move in the opposite direction to forcibly dispense said material out of said first end of said tube, a ratchet assembly mounted on said tube, said ratchet assembly including a drum rotatable both clockwise and counterclockwise and cog means for incrementally advancing said piston and plunger assembly toward said one end of said tube, said puller wire wound around said drum a plurality of times sufficient to preclude slipping thereon when rotated to dispense said material as said piston and plunger assembly is moved toward said first end of said housing, said puller wire being enclosed by a sheathing from a point adjacent to said ratchet assembly to said triangular shaped blade for positioning said puller wire outside said tube and an arcuate shape of sheathing for preventing chafing of said wire where it enters said first end of said tube, and said ratchet assembly further including a cog for incrementally advancing said piston toward said one end of said tube and pawl means for preventing reverse rotation of said drum during a material dispensing operation.

* * * * *